US005876815A

United States Patent [19]

Sandstrom et al.

[11] Patent Number: 5,876,815

[45] Date of Patent: Mar. 2, 1999

[54] OIL AND GREASE RESISTANT PAPER PRODUCTS AND PROCESS FOR PRODUCING THE PRODUCTS

[75] Inventors: Erland R. Sandstrom, Menasha; Kenneth John Shanton, Neenah; Timothy Paul Hartjes, Kimberly; Dean Patrick Swoboda, DePere, all of Wis.

[73] Assignee: James River Corporation of Virginia, Richmond, Va.

[21] Appl. No.: 591,016

[22] Filed: Jan. 25, 1996

[51] Int. Cl.[6] ..... B32B 25/14

[52] U.S. Cl. ..... 428/36.8; 428/34.2; 428/35.9; 428/421; 428/422

[58] Field of Search ..... 428/34.2, 35.9, 428/421, 422, 36.8

[56] References Cited

U.S. PATENT DOCUMENTS

| | | | |
|---|---|---|---|
| 3,341,349 | 9/1967 | Feeney et al. | 117/44 |
| 3,371,002 | 2/1968 | Reddeman | 156/244 |
| 4,272,569 | 6/1981 | Shaw et al. | 427/336 |
| 4,341,839 | 7/1982 | Shaw et al. | 428/342 |
| 4,391,833 | 7/1983 | Self et al. | 426/523 |
| 4,426,466 | 1/1984 | Schwartz | 523/455 |
| 4,489,112 | 12/1984 | Wise et al. | 428/35 |
| 4,513,036 | 4/1985 | Thompson et al. | 428/35 |
| 4,529,658 | 7/1985 | Schwartz et al. | 428/421 |
| 4,537,815 | 8/1985 | Wise et al. | 428/219 |
| 4,698,246 | 10/1987 | Gibbons et al. | 428/35 |
| 5,330,622 | 7/1994 | Honnorat et al. | 162/135 |
| 5,370,919 | 12/1994 | Fieuws et al. | 428/96 |
| 5,626,930 | 5/1997 | Fukushi et al. | 428/36.9 |

OTHER PUBLICATIONS

Abstract –"Oil Resistance Utilizing Fluorochemicals," Schwartz, Craig, 3M 1987 Sizing Short Course, pp. 71–75.

Product Information Sheet, Airflex 100 HS Latex Coating Binder, Air Products and Chemicals, Inc. 1978, 1983.

Product Safety Information, Material Safety Data Sheet for Lodyne P–201 Revision 4 Aug. 30, 1995, Printed Dec. 8, 1995, CIBA–Geigy Corporation.

Product Information Sheet, Lodyne P–201, "High Performance Oil/Grease Repellant for Paper," Paper Dyes & Chemicals, CIBA–Geigy Corporation.

Product Safety Information, Material Safety Data Sheet for Lodyne P–208E Revision 2 Aug. 30, 1995, Printed Dec. 8, 1995, CIBA–Geigy Corporation.

Production Information Sheet, Lodyne P–208E, "High Performance Oil/Grease Repellant for Paper," Paper Dyes & Chemicals, CIBA–Geigy Corporation.

"Pigments (Inorganic," vol. 17, pp. 798; 815; 831–836.

Glossary of Terms Used in Corn Wet–Milling, Penford Products Co.

Repellency of Paper and Board to Grease, Oil, and Waxes (Kit Test), UM 557, TAPPI Useful Methods, 1991, pp. 175–176.

Product Information Sheet, "Scotchban FC–807. The Proven Solution For Paper Protection," 3M.

Product Information Sheet, "Introducing FX–845. Scotchban Chemistry Takes On A New Element," 3M Protective Chemical Products Division, 1993.

Product Information Sheet, "Sequapel 1442 –Fluorochemical Repellent Paper and Paperboard Applications," Sequa Chemicals, Inc.

*Primary Examiner*—Charles Nold

*Attorney, Agent, or Firm*—Finnegan, Henderson, Farabow, Garrett & Dunner, L.L.P.

[57] ABSTRACT

A laminate product having both improved grease, oil, wax and solvent repellency and improved glueability and printability properties. The laminate comprises a substrate, at least one layer of a fluorine containing polymer moiety on at least one surface of the substrate and at least one layer comprising a latex on the at least one layer of a fluorine containing polymer moiety layer. Preferably there are more than one fluorine containing polymer moiety layers. Preferably there are more than one layers comprising a latex. A container is constructed from the said laminate. A process for decreasing the contact angle of grease, oil, wax and solvent involving applying the layers to a substrate.

16 Claims, 2 Drawing Sheets

OIL AND GREASE RESISTANT PAPER PRODUCTS AND PROCESS FOR PRODUCING THE PRODUCTS

FIELD OF THE INVENTION

The present invention relates to a laminate product having improved grease, oil, wax and solvent repellency. More particularly, the present invention relates to containers that are resistant to penetration by grease, oil, wax and solvents. Still further, the present invention relates to a process for imparting grease, oil, wax and solvent repellency to base products.

BACKGROUND OF THE INVENTION

The coating of substrates such as paper products with fluorochemicals to impart grease, oil, wax and solvent repellency has been known for some time. For example, Schwartz, "Oil Resistance Utilizing Fluorochemicals," TAPPI, Seminar Notes, 74, 71–75, (1987), discloses the use of commercially available FDA cleared fluorochemicals to impart resistance to low surface tension fluids on various substrates. U.S. Pat. No. 4,426,466 discloses treatment compositions containing fluorochemical carboxylic acid and epoxidic cationic resin to impart oil and water repellency to cellulosic materials. U.S. Pat. No. 4,529,658 discloses fluorochemical copolymers useful for imparting oil and water repellency to cellulosic and textile materials. U.S. Pat. No. 5,370,919 discloses fluorochemical compositions for imparting oil and water repellency to various substrates.

While these fluorochemical coatings are considered satisfactory for imparting grease, oil, wax and solvent repellency to substrates such as paper products, fluorochemical coatings generally suffer from the disadvantage of interfering with the glueability and the printability of the coated product.

SUMMARY OF THE INVENTION

Accordingly, the present invention is directed to a laminate product and container constructed therefrom that overcome the problems and disadvantages of the prior art fluorochemical coatings. Further, the invention is directed to a process for imparting grease, oil, wax and solvent repellency to base products.

To achieve the foregoing and other advantages and in accordance with the purpose of the invention, as embodied and broadly described herein, one embodiment of the invention is directed to a laminate product having a substrate, at least one layer of a fluorine containing polymer moiety on a surface of the substrate and at least one layer comprising a latex on the at least one fluorine containing polymer moiety layer.

A further embodiment of the invention is directed to a container constructed from the above mentioned laminate product.

In another embodiment, the invention relates to a process for decreasing the contact angle of grease, oil, wax and solvent to a substrate including coating a substrate, e.g. paper, with at least one base layer of a fluorine containing polymer moiety and then coating the at least one fluorine containing polymer moiety layer with at least one layer comprising a latex.

Additional features and advantages of the invention will be set forth in the description which follows, and in part will be apparent from the description, or may be learned by practice of the invention. The objectives and other advantages of the invention will be realized and attained by means of the elements and combinations particularly pointed out in the appended claims.

It is understood that both the foregoing general description and the following detailed description are exemplary and explanatory and are intended to provide further explanation of the invention as claimed.

The accompanying drawings provide a further understanding of the invention, are incorporated in and constitute part of this specification, and illustrate embodiments of the invention. These drawings together with the description, serve to explain the invention, or its objects, advantages or principles.

BRIEF DESCRIPTION OF THE DRAWING

The drawings show embodiments of the invention. In particular they show laminates of the present invention.

DETAILED DESCRIPTION

Reference will now be made in detail to the present preferred embodiments of the invention, examples of which are illustrated in the accompanying drawings.

Figure 1:
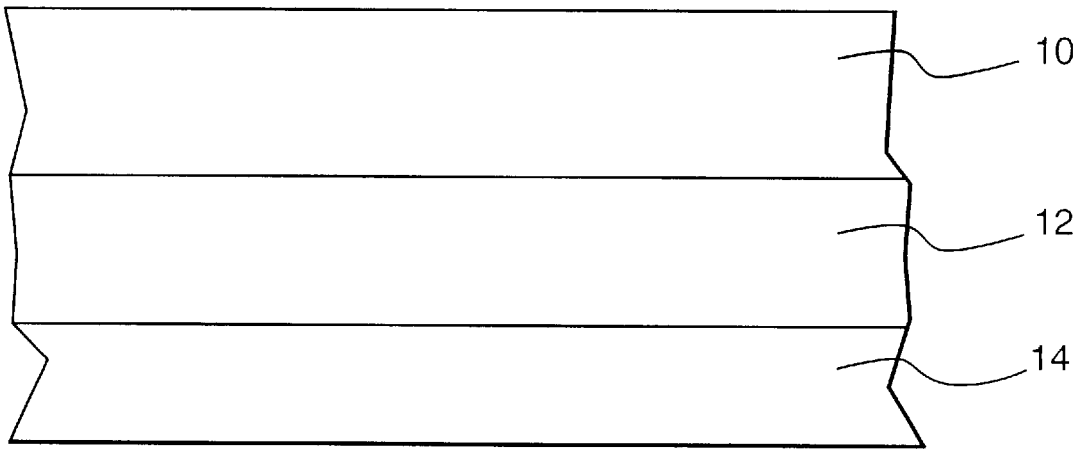
FIG. 1 illustrates a three layer laminate according to one embodiment of the present invention.

As embodied herein and referring to FIG. 1, a laminate of one embodiment of the present invention comprises a substrate 10, a layer of fluorine containing polymer moiety 12, and a layer comprising a latex 14.

The substrate 10 may be made of any suitable material. By way of example, the substrate 10 may be made of a cellulosic material, such as paper or paperboard. Suitable paper and paperboard substrates are commercially available as "DIXIE®" paper and paperboards. ("DIXIE®" is a registered trademark of James River Corporation) The substrate 10 may also be made of a synthetic material, for example, a material made of synthetic fibers. Laminates of the present invention having substrates made of synthetic materials are of particular use to produce synthetic packaging.

Preferably, the substrate 10 has been subjected to sizing and contains a sizing agent. Any suitable sizing technique known in the art may be used. By way of example, suitable sizing techniques include surface sizing and internal sizing. Any suitable sizing agent known in the art may be used. By way of example, suitable sizing agents include starch, starch latex copolymers, animal glue, methyl cellulose, carboxymethyl cellulose, polyvinyl alcohol, and wax emulsions. Preferably, starch or a starch latex copolymer is employed as a sizing agent.

By way of example, suitable commercially available sizing agents containing starch include "PENFORD® GUMS 200,""PENFORD® GUMS 220," "PENFORD® GUMS 230," "PENFORD® GUMS 240," "PENFORD® GUMS 250," "PENFORD® GUMS 260," "PENFORD® GUMS 270," "PENFORD® GUMS 280," "PENFORD® GUMS 290," "PENFORD® GUMS 295," "PENFORD® GUMS 300," "PENFORD® GUMS 330," "PENFORD® GUMS 360," "PENFORD® GUMS 380," "PENFORD® GUMS PENCOTE®," " PENFORD® GUMS PENSPRAE®3800," "PENFORD® GUMS PENSURF," "PENGLOSS®," "APOLLO® 500," "APOLLO®600," "APOLLO®600-A," "APOLLO®700," "APOLLO®4250," "APOLLO®4260," "APOLLO®4280," "ASTRO® GUMS 3010," "ASTRO® GUMS 3020," "ASTROCOTE®75," "POLARIS® GUMS HV," "POLARIS® GUMS MV," "POLARIS® GUMS LV," "ASTRO® X 50," "ASTRO® X 100,"ASTRO® X 101," ASTRO® X 200," "ASTRO® GUM 21," "CALENDER SIZE 2283," "DOUGLAS®-COOKER 3006," "DOUGLAS®-COOKER 3007," "DOUGLAS®-COOKER 3012-T," "DOUGLAS®-COOKER 3018," "DOUGLAS®-COOKER 3019," "DOUGLAS®-COOKER 3040," "CLEARSOL® GUMS 7," "CLEARSOL® GUMS 8," "CLEARSOL® GUMS 9," "CLEARSOL® GUMS 10," "DOUGLAS®-ENZYME 3622," "DOUGLAS®-ENZYME E-3610," "DOUGLAS®-ENZYME E-3615," "DOUGLAS®-ENZYME 3022," "DOUGLAS®-ENZYME 3023," "DOUGLAS®-ENZYME 3024," "DOUGLAS®-ENZYME E," "DOUGLAS®-ENZYME EC," "CROWN THIN BOILING X-10," "CROWN THIN BOILING X-18," "CROWN THIN BOILING XD," "CROWN THIN BOILING XF," "CROWN THIN BOILING XH," "CROWN THIN BOILING XJ," "CROWN THIN BOILING XL," "CROWN THIN BOILING XN," "CROWN THIN BOILING XP," "CROWN THIN BOILING XR," "DOUGLAS®-UNMODIFIED PEARL," and "DOUGLAS®-UNMODIFIED 1200." These sizing agents are all commercially available from Penford Products Co. "PENFORD®," "PENCOTE®," "PENSPRAE®," "PENGLOSS®," "APOLLO®,""ASTRO®," "ASTROCOTE®," "POLARIS®," "DOUGLAS®," and "CLEARSOL®"are all registered trademarks of Penford Products Co. Other suitable starches, including "SILVER MEDAL PEARL™," "PEARL B," "ENZO 32 D," "ENZO 36W," "ENZO 37D," "SUPERFILM 230D," "SUPERFILM 235D," "SUPERFILM 240DW," "SUPERFILM 245D," "SUPERFILM 270W," "SUPERFILM 280DW," "PERFORMER 1," "PERFORMER 2," "PERFORMER 3," "CALIBER 100," "CALIBER 110," "CALIBER 124," "CALIBER 130," "CALIBER 140," "CALIBER 150," "CALIBER 160," "CALIBER 170," "CHARGE +2," "CHARGE +4,"CHARGE +7," "CHARGE +9," "CHARGE +88," "CHARGE +99," "CHARGE +110," "FILMFLEX 40," "FILMFLEX 50," "FILMFLEX 60," and "FILMFLEX 70," are all commercially available from Cargill.

The layer of fluorine containing polymer moiety 12, may be any suitable fluorine containing polymer moiety known to the art. By way of example, suitable fluorine containing moiety polymers include fluorochemical copolymers. A preferable fluorochemical copolymer is ammonium di-[2-(N-ethyl-heptadecafluorosulfonamido)ethyl]phosphate. Ammonium di-[2-(ethyl-heptadecafluorosulfonamido) ethyl]phosphate is commercially available as "SCOTCHBAN FC-807" (a trademark of 3M). "SCOTCHBAN FC-807" can be formed by the reaction of 2,2-bis[Γ,ω-perfluoro $C_{4-20}$ alkylthio)methyl]-1,3-propanediol, polyphosphoric acid and ammonium hydroxide. Other suitable fluorine containing moiety polymers include fluorochemical phosphates. A commercially available fluorochemical phosphate includes "SCOTCHBAN FC-809" (a trademark of 3M). "SCOTCHBAN FC-809" is an ammonium salt of a fluoroaliphatic-polymer. Other suitable fluorine containing moiety polymers include fluoroalkyl polymers. A preferable fluoroalkyl polymer is poly(2-(N-methyl-heptadecafluorosulfonamido)ethyl acrylate)-co-(2,3-epoxypropylacrylate)-co-(2-ethoxyethylacrylate)-co-(2-(2-methylpropenyloyloxy) ethyl-trimethylammonium chloride). Poly(2-(N-methyl-heptadecafluorosulfonamido) ethyl acrylate)-co-(2,3-epoxypropylacrylate)-co-(2-ethoxyethylacrylate)-co-(2-(2-methylpropenyloyloxy)ethyl-trimethylammonium chloride) is commercially available as "SCOTCHBAN FX-845" (a trademark of 3M). "SCOTCHBAN FX-845" contains 35 to 40 weight percent fluorine and can be produced by the copolymerization of ethanaminium, N,N,N-trimethyl-2-[(2-methyl-1-oxo-2-propenyl)-oxy]-, chloride; 2-propenoic acid, 2-methyl-, oxiranylmethylester; 2-propenoic acid, 2-ethoxyethyl ester; and 2-propenoic acid, 2[[(heptadecafluorooctyl) sulfonyl] methyl amino] ethyl ester. Another suitable commercially available fluorine containing moiety polymer includes "SEQUAPEL 1422" (a registered trademark of Sequa Chemicals, Inc.) Other suitable commercially available fluorine containing moiety polymers include "LODYNE® P-201" and "LODYNE® P-208E." "LODYNE® P-201" and "LODYNE® P-208E" are registered trademarks of Ciba-Geigy Corporation, Greensboro, N.C. "LODYNE® P-201" comprises a fluorinated organic acid diethanolamine salt having a 34% solids content, the remaining 66% comprising water. "LODYNE® P-208E" comprises a fluorinated alcohol phosphate ester salt having a 24% solids content, a 10% propylene glycol content, and a 66% water content.

The layer of fluorine containing polymer moiety 12, may also contain additives. By way of example, the layer of fluorine containing polymer moiety 12 may contain any suitable film-former known in the art. By way of example, suitable film-formers include polyvinyl alcohol, starch, chemically modified starches such as oxidized, ethylated and cationized starch, and other natural and synthetic film formers. Films are characterized by having greater cohesion than adhesion for cellulosic fibers.

The layer comprising a latex 14, may contain any suitable latex known to the art. By way of example, suitable latexes include styrene-acrylic copolymer, acrylonitrile styrene-acrylic copolymer, polyvinyl alcohol polymer, acrylic acid polymer, ethylene vinyl alcohol copolymer, ethylene-vinyl chloride copolymer, ethylene vinyl acetate copolymer, vinyl acetateacrylic copolymer, styrene-butadiene copolymer and acetateethylene copolymer. Preferably, the layer comprising a latex 14 contains styrene-acrylic copolymer, styrene-butadiene copolymer, or vinyl acetate-acrylic copolymer. More preferably, the layer comprising a latex 14 contains vinyl acetate ethylene copolymer. A commercially available vinyl acetate ethylene copolymer is "AIRFLEX® 100HS" latex. ("AIRFLEX® 100HS" is a registered trademark of Air Products and Chemicals Inc.)

Preferably, the layer comprising a latex 14 contains a latex that is pigmented. Pigmenting the latex increases the coat weight of the layer comprising a latex 14, thus reducing runnability problems when using blade coaters to coat the substrate 10. Pigmenting the latex also improves the resulting print quality of print that may be applied to the laminate of the present invention. Suitable pigments include kaolin clay, delaminated clays, structured clays, calcined clays, alumina, silica, aluminosilicates, talc, calcium sulfate, ground calcium carbonates, and precipitated calcium carbonates. Other suitable pigments are disclosed, for example, in *Kirk-Othmer, Encyclopedia of Chemical Technology,* Third Edition, Vol. 17, Pp. 798, 799, 815, 831–836, which is incorporated herein by reference. Preferably the pigment is selected from the group consisting of kaolin clay and conventional delaminated coating clay. A available delaminated coating clay is "HYDRAPRINT" slurry, supplied as a dispersion with a slurry solids content of about 68%. "HYDRAPRINT" slurry is a trademark of Huber.

The layer comprising a latex 14 may also contain other additives that are well known in the art to enhance the properties of the laminates comprising a latex, or are well known in the art to better enable laminates comprising a latex to be manufactured. By way of example, suitable additives include clays, dispersants, lubricants, defoamers, film-formers, antifoamers and crosslinkers.

By way of example, "DISPEX N-40" is one suitable organic dispersant and comprises a 40% solids dispersion of sodium polycarboxylate. "DISPEX N-40" is a trademark of Allied Colloids.

By way of example, "BERCHEM 4095" is one suitable lubricant and comprises 100% active coating lubricant based on modified glycerides. "BERCHEM 4095" is a trademark of Bercen.

By way of example, "Foamaster DF-122NS" is one suitable defoamer. "Foamaster DF-122NS" is a trademark of Henkel.

In a preferred embodiment, the laminate comprises multiple layers of fluorine containing polymer moieties. Having multiple layers of fluorine containing polymer moieties reduces the probabilities of the laminate demonstrating pinholes.

In a preferred embodiment, the laminate comprises multiple layers that comprise a latex. The addition of multiple layers that comprise a latex improves the resulting print quality of print that may be applied to the laminate of the present invention.

Figure 2:
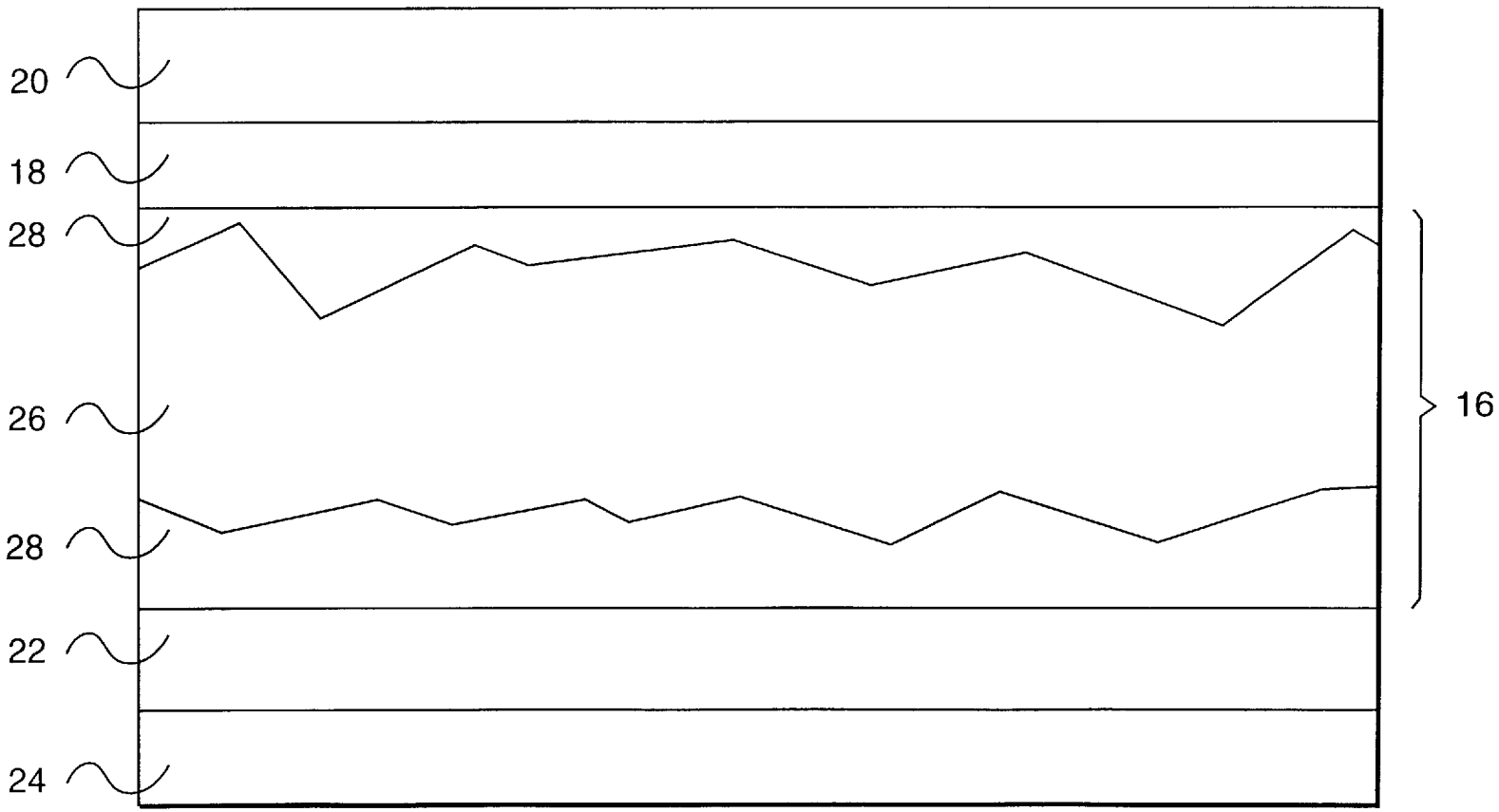
FIG. 2 illustrates a multi-layer laminate of the present invention.

An example of a preferred embodiment as described above, having multiple layers of fluorine containing polymer moieties and multiple layers that comprise a latex is shown in FIG. 2. The laminate as shown in FIG. 2 comprises a substrate 16, a layer of fluorine containing polymer moiety 18, and three layers that comprise a latex 20, 22, and 24.

In the preferred embodiment as depicted in FIG. 2, the substrate 16 is made of a fiber core 26 having a size press starch coating 28.

In the preferred embodiment as depicted in FIG. 2, the layer of fluorine containing polymer moiety 18 is "SCOTCHBAN FX845."

In the preferred embodiment as depicted in FIG. 2, the three layers containing a latex 20, 22, and 24 are "Hiflex Coating" layers. "Hiflex Coating" layers are layers that comprise "AIRFLEX® 100HS" latex.

The aforementioned layers may be applied using any suitable method known in the art. For example, the layers may be applied utilizing size-press addition, calendar box addition, blade coater addition, rod coater addition, gravure roll addition, roll coater addition, air knife coater addition, spraying, or a combination of the aforementioned.

The laminates of the present invention can be easily fabricated. For example, the fluorine containing polymer moiety layer and the layer that comprises a latex may be simultaneously and directly applied onto the substrate.

Alternatively, a two stage coating operation may be utilized whereby the fluorine containing polymer moiety layer is applied onto the substrate and subsequently overcoated with the layer that comprises a latex.

Similarly, when applying multiple fluorine containing polymer moiety layers and/or multiple layers that comprise a latex, a one or two stage coating operation may be utilized.

In accordance with the invention, there is provided a container that is resistant to grease, oil, wax and solvent. The container is formed from the laminate of the present invention. The container may be formed using any method known to the art. For example, the container may be formed by placing a blank of the laminate over a female die and pressing downwardly thereon with a mating head of a male die.

EXAMPLES

The invention is further illustrated by the following examples.

Table 1 illustrates the superior grease, oil, wax and solvent repellency and the improved glueability and printability properties of laminates of the present invention. The table compares a laminate of the present invention (II) with control laminates (I), (III), (IV), and (V). "SCOTCHBAN FX-845" was used as the fluorohydrocarbon in all of the laminates illustrated in table 1. Similarly, "AIRFLEX 100 HS" latex was used as the latex in the layer containing a latex in all the laminates illustrated in Table 1. More specifically, Table 2 illustrates the materials contained in the layer containing the latex. Thus, for example, laminate (II), a preferred embodiment of the present invention, comprises a paperboard substrate having a top side coating of fluorohydrocarbon "SCOTCHBAN FX-845," a coating of a layer containing "AIRFLEX 100 HS" latex on the "SCOTCHBAN FX-845" top side coating, and two bottom side coatings of layers containing "AIRFLEX 100 HS" latex.

The grease, oil, wax and solvent repellency of the laminates were tested using the "SCOTCHBAN® PAPER PROTECTOR TEST KIT." ("SCOTCHBAN® PAPER PROTECTOR TEST KIT" is a registered trademark of the 3M Company.) The results of the tests utilizing the "SCOTCHBAN® PAPER PROTECTOR TEST KIT" are depicted in Table 1, adjacent the row headed "3M Kit Number." The results obtainable from the "SCOTCHBAN® PAPER PROTECTOR TEST KIT" are 0–12+, wherein 12+ demonstrates the maximum measurable grease, oil, wax and solvent repellency.

The laminates were also tested for their ability to withhold corn oil at a score using the following test method:

TEST METHOD

With the test side face down, each laminate to be tested was inflicted with a 0.070" score. To prevent edge wicking, tape was placed around the edges of the score to be tested. The laminate samples were folded to 90° at the score, wherein the test side was facing inward. Putty was placed at both vertexes to form a trough. 2 mL of corn oil was poured into the trough and left for 20 minutes. After removing the oil and wiping the excess oil from the laminate, the percentage of oil soaked into the score as seen on the non-test side was recorded. These results are depicted in Table 1, adjacent the row headed "Grease Resistance at the Score % Failure".

TABLE 1

| Options | Control (I) | Embodiment of Invention (II) | Control (III) | Control (IV) | Control (V) |
|---|---|---|---|---|---|
| Fluorohydrocarbon[1] | | | | | |
| Bottom Side | No | No | No | Yes | Yes |
| Top Side | No | Yes | Yes | No | No |
| Layer containing a Latex | Yes | Yes | Yes | Yes | Yes |
| Bottom Side[2] | Yes | Yes | No | Yes | No |
| Top Side[1] | | | | | |
| 3M Kit Number | | | | | |
| Bottom Side | 7 | 7 | 7 | 12+ | 12+ |
| Top Side | 5 | 12+ | 9 | 5 | <3 |
| Grease Resistance at | 100 | 0–10 | 30 | 30 | 100 |
| the Scores % Failure | Poor | Excellent | Good | Good | Poor |
| Coupon Printing | Excellent | Excellent | Marginal | Excellent | Marginal |
| Glueability | Excellent | Excellent | Marginal | Excellent | Good |
| Minimum Run Size | 60 Tons | 200 to 400 Tons | 200 to 400 Tons | 200 to 400 Tons | 200 to 400 Tons |

[1]Applied in a Calender Box
[2]Applied in a Trailing Blade Coater

TABLE 2

| Material | Material Type | Parts | % Sol. | Dry Wt.(g) | Wet Wt.(g) |
|---|---|---|---|---|---|
| Hydraprint slurry | Clay | 100 | 69.5 | 12000 | 17266 |
| Dispex N-40 | Dispersant | 0.1 | 70 | 12 | 30 |
| Airflex 100 HS | Latex | 29 | 55 | 3480 | 6327 |
| Berchem 4095 | Lubricant | 1.0 | 100 | 120 | 120 |
| Foamaster DF-122NS | Defoamer | 0.1 | 100 | 12 | 12 |

% Solids = 64.9

It may be apparent to those skilled in the art that various modifications and variations can be made to the laminate product of the present invention without departing from the spirit or scope of the invention. Thus, it is intended that the present invention cover modifications and variations of this invention provided they come within the scope of the appended claims and their equivalents.

We claim:

1. A laminate product comprising:

a substrate;

at least one layer of a fluorine containing polymer on a surface of the substrate; and at least one layer comprising a latex on the at least one fluorine containing polymer layer.

2. A laminate product as claimed in claim 1, wherein the substrate is paper.

3. A laminate product as claimed in claim 1, wherein the substrate is paperboard.

4. A laminate product as claimed in claim 1, wherein the latex is pigmented.

5. A laminate product as claimed in claim 1, wherein the latex is selected from the group consisting of styrene-acrylic copolymer, acrylonitrile styrene-acrylic copolymer, polyvinyl alcohol polymer, acrylic acid polymer, ethylene vinyl alcohol copolymer, ethylene-vinyl chloride copolymer, ethylene vinyl acetate copolymer, vinyl acetate-acrylic copolymer, styrene-butadiene copolymer and acetate-ethylene copolymer.

6. A laminate product as claimed in claim 1, wherein the latex is vinyl acetate ethylene copolymer.

7. A laminate product as claimed in claim 1, wherein the fluorine containing polymer comprises carbon atoms.

8. A laminate product as claimed in claim 1, wherein the fluorine containing polymer is a copolymer comprising carbon and fluorine moieties.

9. A laminate product as claimed in claim 1, wherein the fluorine containing polymer is a polymer comprising phosphate and fluorine moieties.

10. A laminate product as claimed in claim 1, wherein the fluorine containing polymer is a fluoralkyl polymer.

11. A laminate product as claimed in claim 1, wherein the fluorine containing polymer is perfluoroalkylethylphosphate diethanolamine.

12. A laminate product as claimed in claim 1, wherein the fluorine containing polymer is ammonium di-[2-(N-ethylheptadecafluorosulfonamido)ethyl]phosphate.

13. A laminate product as claimed in claim 1, wherein the fluorine containing-polymer is poly(2-(N-methylheptadecafluorosulfonamido) ethyl acrylate)-co-(2-,3epoxypropylacrylate)-co-(2-ethoxyethylacrylate)-co-(2-(2-methylpropenyloyloxy)ethyl-trimethylammonium chloride).

14. A laminate product as claimed in claim 1, wherein the fluorine containing polymer comprises a fluorinated organic acid diethanolamine salt.

15. A laminate product as claimed in claim 1, wherein the fluorine containing polymer comprises:

a fluorinated alcohol phosphate ester salt;

a propylene glycol; and water.

16. A container constructed from a laminate product as claimed in claim 1.

* * * * *